United States Patent [19]

Miskin et al.

[11] Patent Number: 4,915,641

[45] Date of Patent: Apr. 10, 1990

[54] MODULAR DRAWER CONNECTOR

[75] Inventors: Michael J. Miskin, Naperville; Wayne A. Zahlit, Downers Grove, both of Ill.

[73] Assignee: Molex Incorporated

[21] Appl. No.: 238,632

[22] Filed: Aug. 31, 1988

[51] Int. Cl.[4] ..... H01R 13/514

[52] U.S. Cl. ..... 439/247; 439/560; 439/701

[58] Field of Search ..... 439/247, 248, 534, 560, 439/680, 701

[56] References Cited

U.S. PATENT DOCUMENTS

| | | | |
|---|---|---|---|
| 4,596,436 | 6/1986 | Kraemer et al. | 439/701 |
| 4,647,130 | 3/1987 | Blair et al. | 439/248 |
| 4,812,133 | 3/1989 | Fleak et al. | 439/248 |

FOREIGN PATENT DOCUMENTS

| | | | |
|---|---|---|---|
| 0236923 | 9/1987 | European Pat. Off. | 439/701 |

*Primary Examiner*—Eugene F. Desmond

*Attorney, Agent, or Firm*—Louis A. Hecht; Stephen Z. Weiss

[57] ABSTRACT

A drawer connector is provided with modular components to facilitate the replacement of those portions of the drawer connector that are subject to the greatest wear. The drawer connector comprises mateable female and male panel mount drawer connector housings having mateable terminals press fit or otherwise lockingly engaged therein. The conductive leads are not permanently terminated to the terminals of the drawer connector. Rather, the conductive leads are terminated to modular connector terminals or terminal assemblies which in turn are lockingly but releasably mounted to the respective rear sides of the panel mount assemblies of the drawer connector. Thus, the panel mount assemblies can be discarded and replaced upon the damage of the frequently connected and disconnected terminals therein, while still retaining the time and labor intensive termination work on the conductive leads. Alignment of the drawer connector housings is facilitated by a frangible float collar formed unitarily with at least one of the housings. The float collar is severed from the remainder of the housing as the housing is connected to the panel. However, the size and relative disposition of the float collar relative to the remainder of the housing permits a controlled floating therebetween.

20 Claims, 6 Drawing Sheets

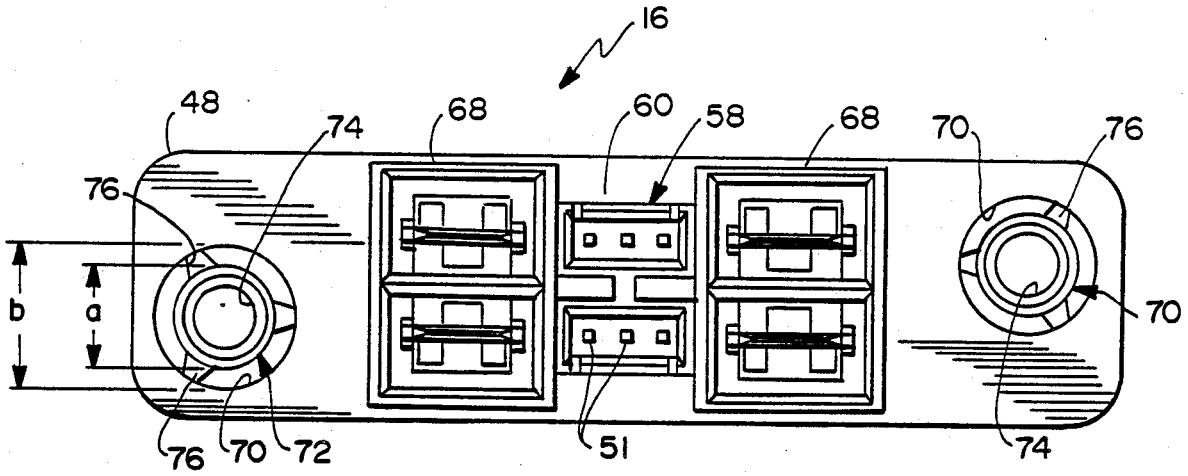
FIG.4
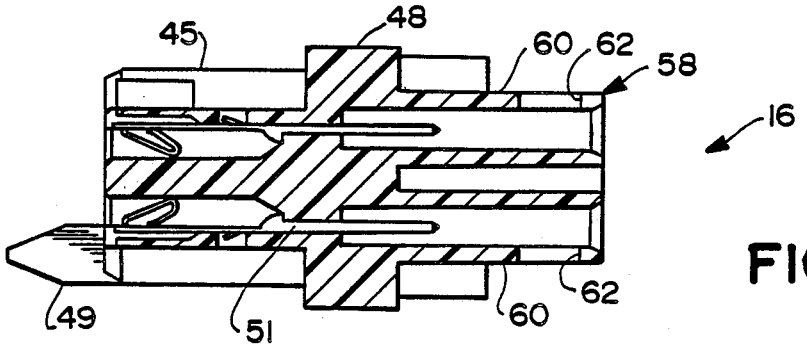
FIG.5
FIG.6
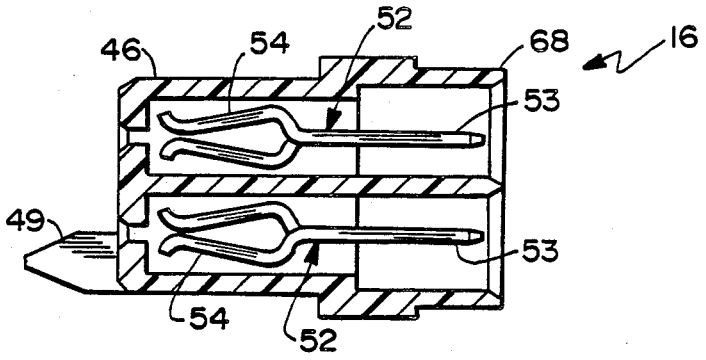

MODULAR DRAWER CONNECTOR

BACKGROUND OF THE INVENTION

Drawer connectors comprise a pair of multi-terminal mateable connector halves. One half of the drawer connector may be mounted to a panel at a substantially inaccessible location within an electrical device, such as a photostatic copier or a computer. The opposed half of the drawer connector may be mounted to a second panel which may be constructed to slide into the copier, computer or other apparatus, such that the respective connector halves achieve a blind mating with one another. Drawer connectors may be used, for example, on the paper trays of certain photostatic copiers and on various replaceable components of computers or telecommunications equipment. Thus, drawer connectors generally define portions of an electrical apparatus that require frequent connection and disconnection. The blind mating inherent with drawer connectors require the connector halves to be provided with appropriate means for guiding the connector terminals into mating electrical connection with one another. Drawer connectors may further comprise floatable mountings to facilitate at least initial alignment.

The typical prior art drawer connector half includes a plurality of AC power lines or DC signal lines permanently connected to terminals which are in turn permanently mounted in the drawer connector housing. More particularly, the signal or power leads may be prepared and terminated with a crimp termination. The terminated lead may then be urged into a force fit or other locked mounted position within the drawer connector housing.

Repeated connection and disconnection of the drawer connector halves subject the terminals therein to significant wear. The effects of this wear may be exacerbated by the blind mating common with drawer connectors. The wear caused by the frequent connection and disconnection and/or by misalignment during the blind mating can easily damage one or more of the terminals in the drawer connector. Such damage is most likely to occur in the smaller more fragile DC signal carrying terminals.

Damage to a terminal in most prior art drawer connectors has necessitated complete replacement of the prior art drawer connector, including all of the labor intensive and costly termination work on the leads and terminals of the connector. For example, the permanent connection of the conductive DC leads to the terminals and the permanent mounting of the terminals in the prior art drawer connector housing, have prevented the replacement of any damaged components in the typical prior art connector. Thus, upon damage to any terminal in a prior art drawer connector, all of the DC and/or AC leads to the prior art drawer connector generally would be severed and the drawer connector half with the costly termination work therein would be discarded. The severed leads would then be reterminated to appropriate terminals, and the terminals would be permanently mounted in a new drawer connector housing. Thus, the initial termination work, at least for the small DC signal lines, is discarded and new termination work is carried out.

The prior art drawer connectors have attempted to deal with the problem of damage to terminals primarily by constructing the drawer connector housing halves to achieve a certain degree of self-aligning during the blind mating process. One example of such a prior art drawer connector is shown in U.S. Pat. No. 4,647,130 which issued to Blair et al. on March 3, 1987. The drawer connector shown in U.S. Pat. No. 4,647,130 includes mateable male and female terminals. The male terminals are surrounded by a forwardly projecting shroud. The female terminals are disposed in a housing that is guided into the shroud surrounding the male terminals by forwardly projecting guides. U.S. Pat. No. 4,647,130 also shows a float mount for the drawer connector which comprises an enlarged flange aperture adapted to receive an elliptical elastomeric insert. A shoulder screw having a diameter smaller than that of the aperture effectively mounts the connector to the panel in a manner which permits the connector to float in the direction of the major axis of the elliptical insert. The permanent eletrical terminations, and the permanent mounting of terminals in the housing of U.S. Pat. No. 4,647,130 are substantially as described above. Thus, the drawer connector of U.S. Pat. No. 4,647,130 suffers from the previously described deficiencies. Furthermore, the plural part float mechanism is complex and costly to assemble.

U.S. Pat. No. 3,947,080 which issued to Ege on March 30, 1976 is directed to a terminal block assembly for plural AC female quick-connect terminals and associated AC leads. One terminal block shown in U.S. Pat. No. 3,947,080 includes a plurality of double ended blade terminals mounted therein. One end of each double ended blade terminal extends from the forwardly facing end of the associated terminal block such that the blade terminals define the forwardmost mating end of the terminal block. The opposed end of each double ended plate terminal is disposed in a rearward cavity of the terminal block dimensioned to receive a female quick-connect terminal. The other terminal block shown in U.S. Pat. No. 3,947,080 includes a plurality of double ended terminals, one end of which defines a rearwardly extending blade and the other end of which defines a forwardly extending blade receiving contact structure. The forward blade receiving end of each terminal in the second block is disposed in a cavity into which the first block is receivable. The rearward end of each terminal in the second block is disposed in a rearward recess dimensioned to receive a female quick-connect terminal. The terminal block assembly of U.S. Pat. No. 3,947,080 is considered undesirable in several respects. First, no means for accommodating float of the blocks is provided. The minimal float provided for some terminals relative to their associated blocks is undesirable in that the terminals will tend to shift to a position of minimum contact pressure. Second, the forward ends of the male terminals are unprotected and would be damaged during most drawer connector matings. Third, the terminal block assembly of U.S. Pat. No. 3,947,080 includes no means for accommodating the arrays of DC leads that are essential parts of many drawer connectors. Furthermore, the teaching of U.S. Pat. No. 3,947,080 would be difficult to apply to terminal block assemblies or drawer connectors having a large number of leads in that extensive time and space would be required in assuring proper lead-for-lead polarity of the various female quick-connect terminals. Similar structures are shown in U.S. Pat. No. 2,944,240 which issued to Barber in 1960 and U.S. Pat. No. 2,746,022 which issued to Gilbert in 1956.

Another prior art drawer connector is shown in U.S. Pat. No. 4,560,222 which issued to Dambach on December 24, 1985 and which is assigned to the assignee of the subject invention. Although this connector performs well, it is desirable to provide an improved drawer connector that achieves better terminal alignment, reduced terminal failure and that minimizes the work that may be required upon a failure of a terminal therein.

In view of the above, it is an object of the subject invention to provide a drawer connector for arrays of DC leads that reduces the amount of work and the costs involved upon the failure of a terminal in the connector.

Another object of the subject invention is to provide a drawer connector wherein the leads to the connector are terminated in modular connectors which in turn are pluggable into the appropriate drawer connector assembly.

An additional object of the subject invention is to provide a modular drawer connector assembly wherein portions of the assembly subject to repeated connection, disconnection and associated wear are readily separable from portions of the assembly at which the leads are terminated.

A further object of the subject invention is to provide a drawer connector assembly with a float mount to facilitate alignment of the connector halves and to thereby reduce wear on the terminals therein.

Still another object of the subject invention is to provide a modular drawer connector having a plurality of terminals securely mounted in and protected by a drawer connector housing.

SUMMARY OF THE INVENTION

The drawer connector of the subject invention comprises opposed mateable female and male panel mountable drawer connector housings. Each drawer connector housing may comprise a panel mounting portion, a forwardly projecting mating end and a rearwardly projecting conductor-receiving end. The forwardly projecting mating ends of the respective drawer connector housings are mateable with one another and may comprise appropriate means for guiding the drawer connector housings through the blind mating process common with drawer connectors.

Electrical terminals are securely and substantially permanently mounted in each drawer connector housing. Each terminal comprises opposed forward and rearward contact means for making electrical contact with other terminals as explained herein. The forward contact means of the terminals in one drawer connector housing are mateable with the forward contact means of the terminals of the opposed drawer connector housing.

The terminals of each drawer connector housing are connected to electrically conductive leads through modular connector assemblies that can be removably engaged with the rearward contact means of the terminals in the conductor-receiving end of each drawer connector housing. For example, each drawer connector housing may include a plurality of drawer connector pin terminals or drawer connector pin receiving terminals for DC circuits. These drawer connector terminals are press fit or otherwise securely and substantially permanently engaged in the drawer connector housing. The pin terminals and pin receiving terminals may be disposed in the respective drawer connector housings such that when the housings are in their mated condition, the pin terminals of one drawer connector housing will be in electrical contact with the pin receiving terminals of the other drawer connector housing. The opposed ends of each drawer connector pin terminal and drawer connector pin receiving terminal, however, may be electrically joined to the modular connector assemblies, which may comprise insulation displacement or crimp terminal assemblies that are securely but removably mounted to the rearward conductor-receiving end of the corresponding drawer connector housing. The DC leads to the insulation displacement or crimp terminal module or other such modular connector assembly may be defined by a ribbon cable or individual insulated wire leads. Selected drawer connector terminals in the drawer connector housing may be double ended blade terminals or blade receiving terminals intended for AC current usage. These blade terminals and blade receiving terminals may be force fit or locked in the appropriate drawer connector housings to mate with one another upon engagement of the forward mating ends of the housings. The opposed ends of the respective blade terminals or blade receiving terminals may be at the conductor-receiving end of the housing and may be connected to terminated wire leads having crimped on quick-disconnect terminals and insulating sleeves. These terminated wire leads are removably mounted to the blade terminals. The drawer connector may comprise all DC terminals or combinations of DC and AC terminals. Furthermore, the unique float construction described herein may be embodied in any drawer connector.

The terminals securely and substantially permanently mounted in the housings of the drawer connector may be subjected to frequent blind connection and disconnection. The frequent application of these insertion forces and the possibility of misalignment due to the blind mating may cause damage to or failure of one or more terminals permanently mounted in the drawer connector. Upon such a failure, the terminal modules removably mounted to the rearward conductor-receiving end of the corresponding drawer connector housing are merely removed, and the housing with the terminals permanently mounted therein is replaced by a new drawer connector housing assembly with corresponding terminals. The original terminal modules permanently connected to conductive leads are connected to the new drawer connector terminals and to the new drawer connector housing. Thus, the modular drawer connector can be put back into use. This construction avoids the time and cost penalties associated with retermination of the plurality of small DC leads as had been required with the prior art drawer connectors.

To facilitate alignment, and thereby reduce the possibility of damage to the drawer connector terminals, at least one drawer connector housing may be provided with a frangible floating collar for mounting the housing to the panel. More particularly, the housing may comprise a plurality of mounting apertures for mounting the housing to a panel. A collar having an outer cross-sectional dimension smaller than the mounting aperture in the housing may be connected to the housing by frangible supports, such that the collar is generally aligned with the mounting aperture in the housing. The collar may be provided with a central through aperture for receiving a mounting bolt, rivet or other connecting means. Furthermore, the collar may extend from an associated surface of the mounting portion of the housing. As a result of this construction, the mounting of the housing to the panel will sever the frangible supports. The bolt, rivet or other attachment means will be securely connected to the collar, thereby enabling the remainder of the housing to float relative to the collar and the attachment means extending therethrough. The amount of float can be positively controlled by the relative dimensions of the frangible collar and of the mounting aperture. This float construction is effective on all drawer connectors, including those having only AC leads.

BRIEF DESCRIPTION OF THE DRAWINGS

FIG. 4 is a rear elevational view of the male half of the drawer connector.

FIG. 5 is a cross section taken along line 5—5 in FIG. 3.

FIG. 6 is a cross section taken along line 6—6 in FIG. 3.

DETAILED DESCRIPTION OF THE PREFERRED EMBODIMENT

Figure 1:
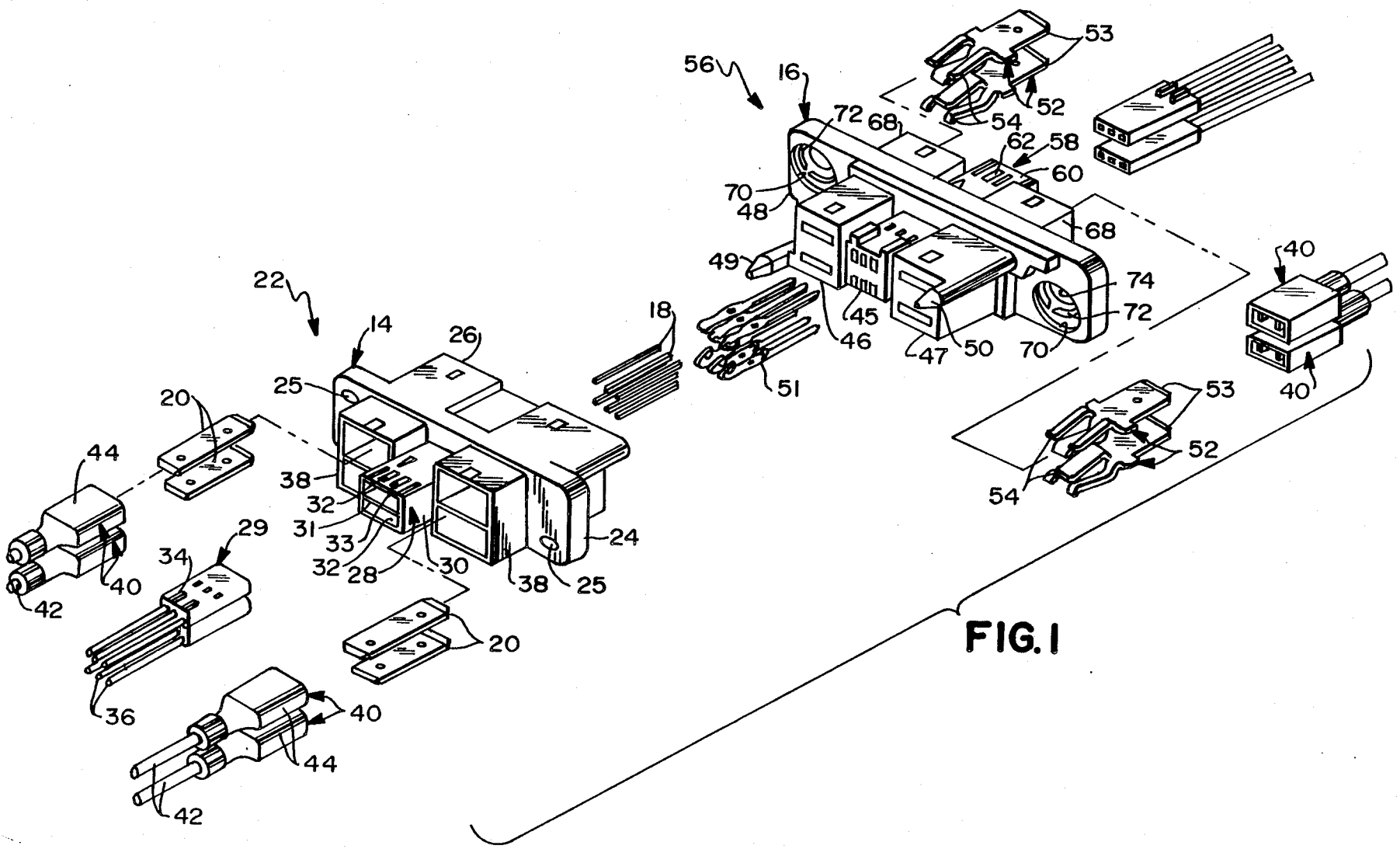
FIG. 1 is an exploded perspective view of the modular drawer connector of the subject invention.
Figure 2:
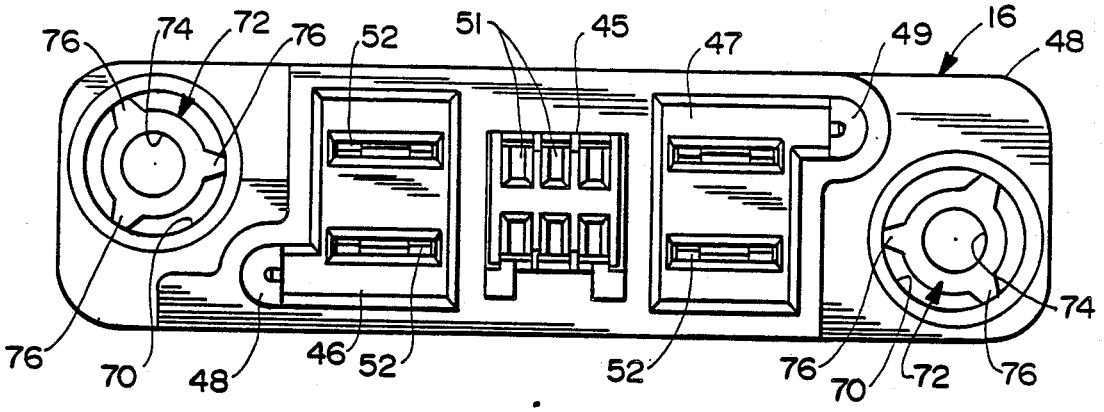
FIG. 2 is a front elevational view of the male half of the drawer connector of the subject invention.

The drawer connector of the subject invention is identified generally by the numeral 12 in FIG. 1. The drawer connector 12 comprises a female panel mount drawer connector housing 14 and a mateable male panel mount drawer connector housing 16. The drawer connector 12, as shown in FIG. 1, is constructed to accommodate both AC and DC circuits. However, it will be understood that many of the advantages described and illustrated herein can be incorporated into drawer connectors for only DC circuits and that the float means can be used on drawer connectors for only DC circuits, only AC circuits as well as the illustrated combination of DC and AC.

The female panel mount drawer connector housing 14, as shown in FIG. 1 and FIGS. 7-11, is of unitary molded plastic construction. A plurality of gold plated pins 18 are press fit in a generally central location within the female panel mount connector housing 14 and enable the completion of the DC circuits accommodated by the drawer connector 12. The female panel mount drawer connector housing 14 further comprises a plurality of double ended blade terminals 20 which also are press fit into the female panel mount connector housing on opposed sides of the pins 18, and define the portion of the drawer connector 12 which enables the completion of the AC circuits. The combination of the female panel mount connector housing 14, the pin terminals 18 and the double ended blade terminals 20 defines a female panel mount drawer connector assembly identified generally by the numeral 22. As noted above, the female panel mount drawer connector assembly 22 can be manufactured with low labor costs, and defines a disposable component which is relatively easily replaceable upon damage of any of the components therein without substantial labor, time and cost penalties.

The female panel mount drawer connector housing 14 includes a planar mounting flange 24 having mounting apertures 25 therethrough for mounting the female panel mount drawer connector assembly 22 to a panel (not shown). A forwardly projecting shroud 26 extends from the mounting flange 24 at the mating end of the drawer connector housing 14 to define a socket which protects the terminals 18, 20 and which mechanically guides the male panel mount drawer connector housing 16 during the blind mating. Dividing walls 27 connect spaced apart locations on the shroud 26 to separate the DC pin terminals 18 from the AC blade terminals 20 and avoid inadvertent damaging contact that could otherwise occur during blind mating.

The rearwardly facing conductor-receiving end of the female panel mount drawer connector housing 14 also defines sockets which extend from the mounting flange 24 and which are constructed to accept modular connector components of the drawer connector 12. In particular, the female panel mount drawer connector housing 14 comprises a generally centrally disposed rearwardly projecting locking socket 28 which is dimensioned to lockingly but releasably and telescopingly receive the DC terminal modules 29. The rearwardly projecting locking socket 28 includes opposed substantially rigid side walls 30 and a transverse wall 31 extending rigidly therebetween. A pair of deflectable cantilevered walls 32 having locking apertures 33 extending therethrough are disposed in parallel spaced relationship to the transverse wall 31. The DC terminal modules 29 include a plurality of appropriately ramped locking projections 34 which are releasably engageable with the apertures 33 in the cantilevered walls 32 of the rearwardly projecting locking socket 28. With this construction two DC terminal modules 29 may be releasably engaged in the shroud 28 at the conductor-receiving end of the drawer connector housing 14. Furthermore, the DC terminal modules 29 can be engaged with the drawer connector housing 14 only if the locking projections 34 thereof are aligned with the deflectable cantilevered wall 32 having the locking apertures 33 therein. Thus, polarity for the plurality of leads 36 extending into DC terminal module 29 is positively assured.

As depicted in FIG. 1, the DC terminal modules 29 define female insulation displacement or crimp terminal assemblies constructed to receive a plurality of separate DC insulated wire leads 36. However, a corresponding DC module for receiving a ribbon cable also could be provided. The DC terminal modules 29 include a plurality of appropriately dimensioned female terminals therein for releasably engaging the pins 18 force fit into the female panel mount connector housing 14. The DC terminal modules 29 can be selectively removed from locking engagement with the rearwardly projecting shroud 28 by virtue of the cantilevered construction of the walls 32 and by virtue of the ramped construction of the locking projections 34.

The female panel mount assembly 22 further comprises rearwardly projecting shrouds 38 which are dimensioned to receive the quick-disconnect AC terminals 40 which in turn are constructed to releasably engage and electrically connect to the double ended blades 22 force fit into the female panel mount drawer connector housing 14. The quick-disconnect AC terminals 40 comprise terminals (not shown) which are crimped on to the insulated wire leads 42, and which are provided with insulating sleeves 44 which are dimensioned to be received in the rearwardly projecting shrouds 38 of the female panel mount connector housing 14.

It will be appreciated by the person skilled in this art that the substantial harness and termination work associated with the female half of the drawer connector 12 is represented in the DC terminal modules 29 which are releasably engageable with the female panel mount drawer connector assembly 22. Thus, by virtue of this construction, the time and labor associated with the termination of the DC leads 36, can be permanently retained despite any damage that may occur due to repeated connection and disconnection of the drawer connector 12.

The male panel mount drawer connector housing 16 defines a centrally disposed forwardly projecting DC plug portion 45 and two forwardly projecting AC plug portions 46 and 47 which extend generally orthogonally from a generally planar mounting flange 48 to define the mating end of the drawer connector housing 16. The forwardly projecting plug portions 45–47 of the male panel mount connector housing are dimensioned to be received within the forwardly projecting shroud 26 and dividing walls 27 of the female panel mount connector housing 14. The mating end of the drawer connector housing 16 further comprises elongated mounting guides 49 and 50 which facilitate the initial blind mating of the respective male and female panel mount drawer connector housings 16 and 14.

A plurality of at least selectively gold plated drawer connector pin receiving terminals 51 are force fit into the central plug portion 45 of the male panel mount drawer connector housing 16. The pin receiving terminals 51 are constructed to receive the pin terminals 18 of the female panel mount assembly 22 to complete the DC circuit portions of the drawer connector 12.

Blade receiving AC terminals 52 are force fit into the forwardly projecting plug portions 46 and 47 of the male panel mount connector housing 16. The AC terminals 52 have rearwardly projecting blade portions 53 and forwardly projecting blade receiving portions 54 which are dimensioned to receive the double ended blade 20 of the female panel mount assembly 22 to complete the AC circuits of the drawer connector 12.

The assembly of the male panel mount connector housing 16, the pin receiving terminals 51 and the AC terminals 52 defines a male panel mount assembly identified generally by the numeral 56 in FIG. 1. As explained above, the male panel mount assembly 56 defines a relatively easily manufactured assembly that is relatively easily replaceable if any of the fragile DC pin receiving terminals 51 therein fail after repeated usage.

The conductor-receiving end of the male panel mount connector housing 16 comprises a centrally disposed rearwardly projecting locking socket 58 having cantilevered locking walls 60 with locking apertures 62 therein substantially as described with respect to the female drawer connector housing 14. DC terminal modules 29 substantially identical to those described above are lockingly but replaceably mountable in the rearwardly projecting locking shroud 58 of the male panel mount connector housing 16, to ensure easy replaceable and polarized mounting of a plurality of DC leads.

The male panel mount connector housing 16 further comprises rearwardly projecting shrouds 68 which are dimensionally comparable to the rearwardly projecting shrouds 38 on the female panel mount connector housing 14. In particular, the rearwardly projecting shrouds 68 are dimensioned to receive the quick-disconnect AC terminals 40 which are substantially identical to those described above. The quick-disconnect AC terminals 40 are removably connectable to the rearwardly projecting blade portions 53 of the AC terminals 52 to complete the AC current carrying portions of the male panel mount assembly 56.

Figure 3:
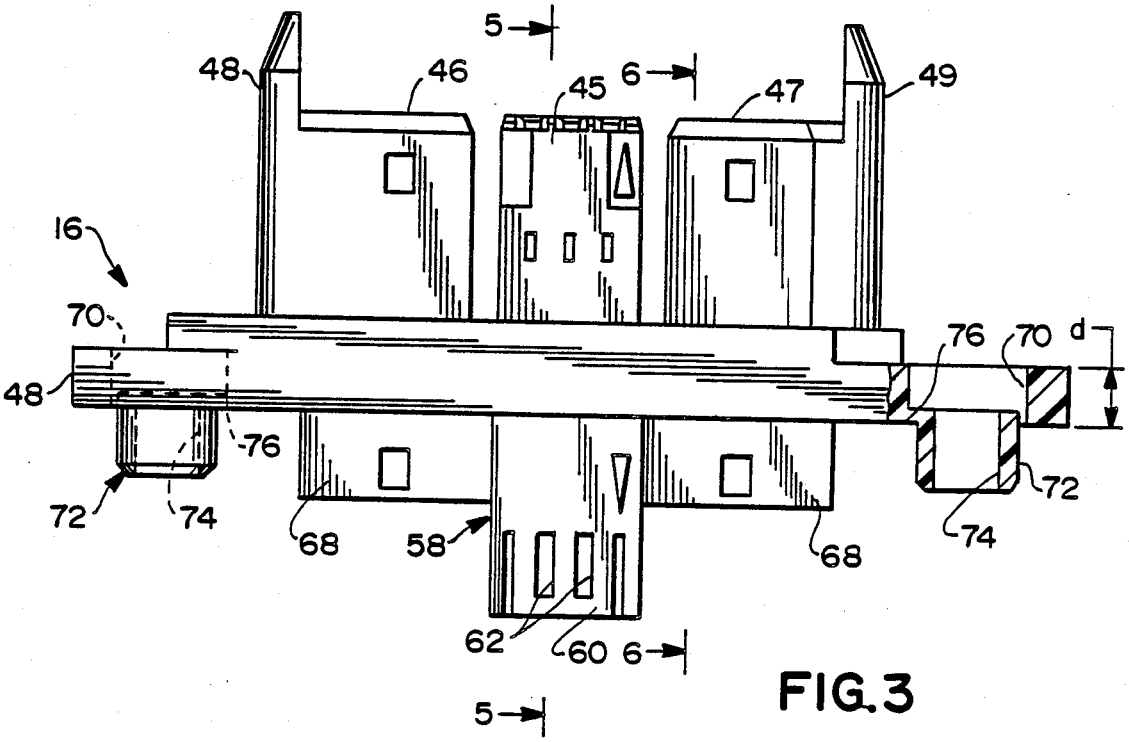
FIG. 3 is a top plan view of the male half of the drawer connector.
Figure 7:
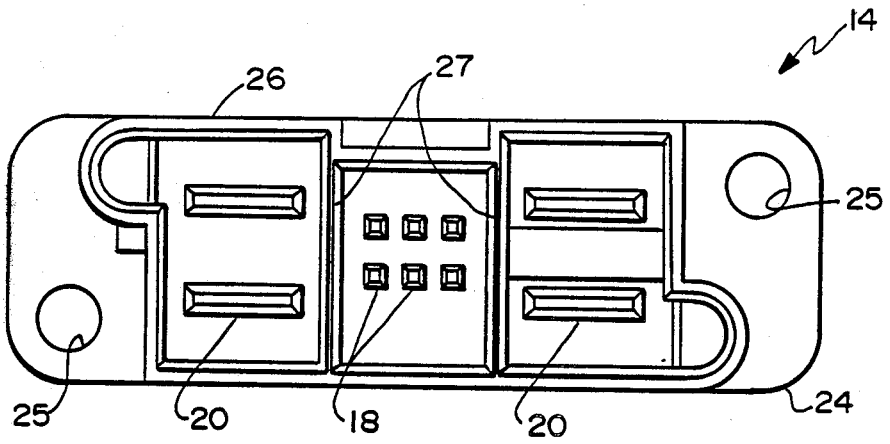
FIG. 7 is a front elevational view of the female half of the drawer connector of the subject invention.
Figure 8:
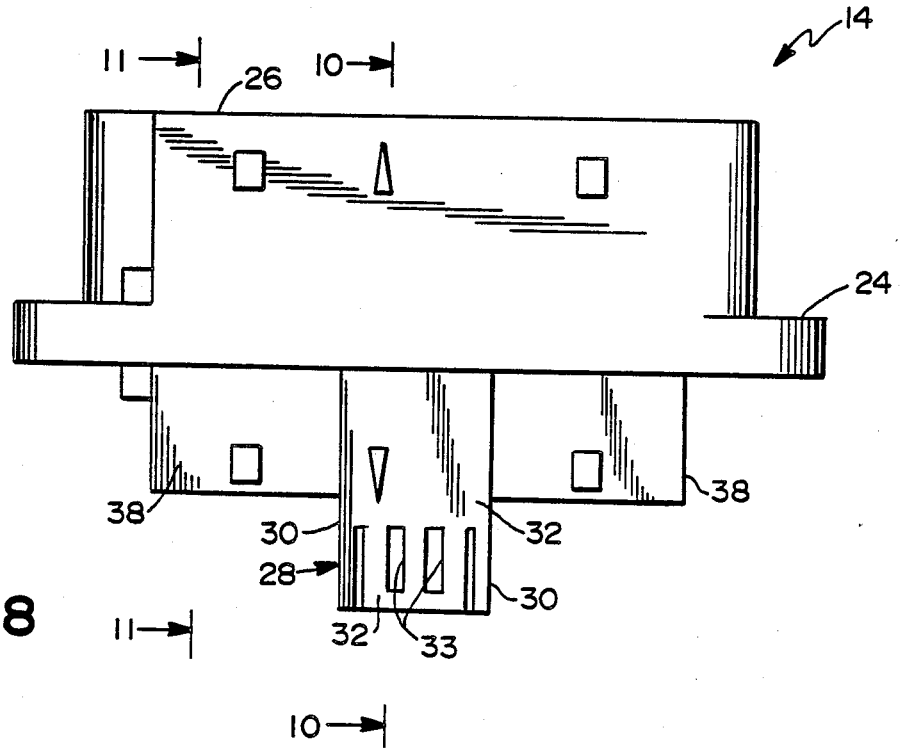
FIG. 8 is a top plan view of the female half of the drawer connector.
Figure 9:
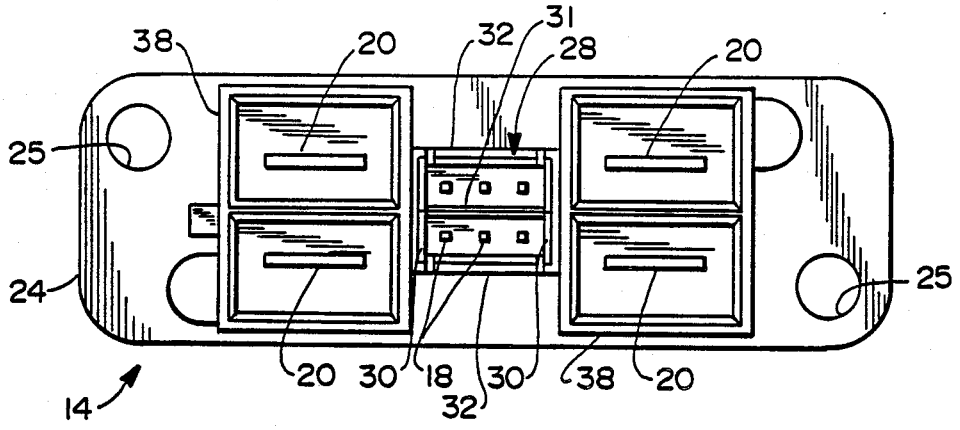
FIG. 9 is a rear elevational view of the female half of the drawer connector.
Figure 10:
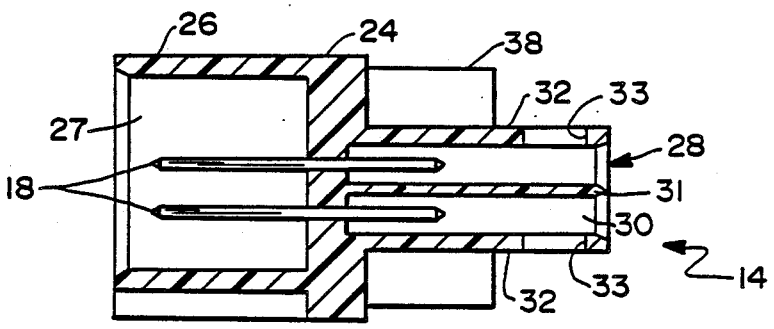
FIG. 10 is a cross section taken along line 10—10 in FIG. 8.
Figure 11:
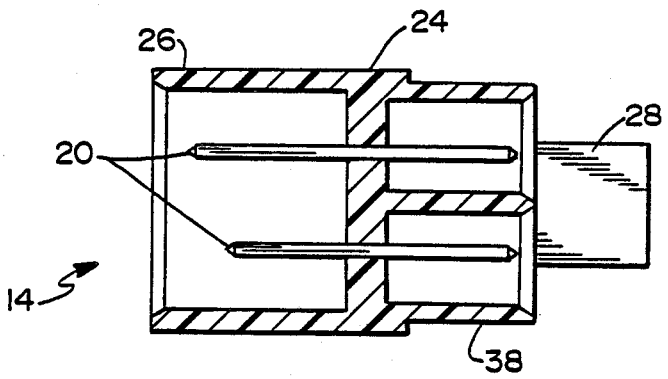
FIG. 11 is a cross section taken along line 11—11 in FIG. 8.
Figure 12:
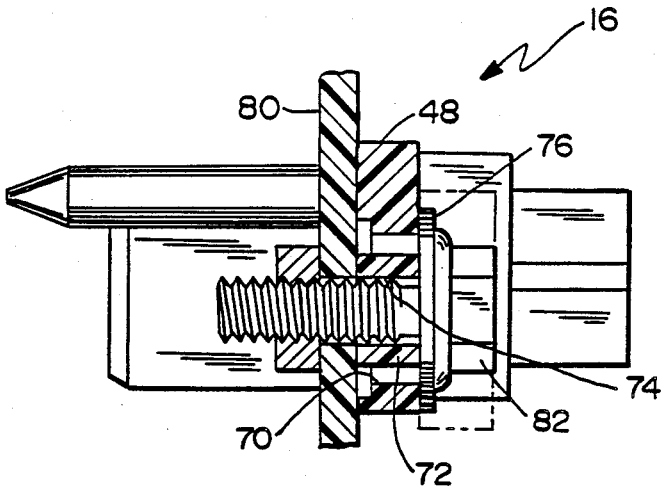
FIG. 12 is a cross-sectional view showing the drawer connector mounted to a panel.
Figure 13:
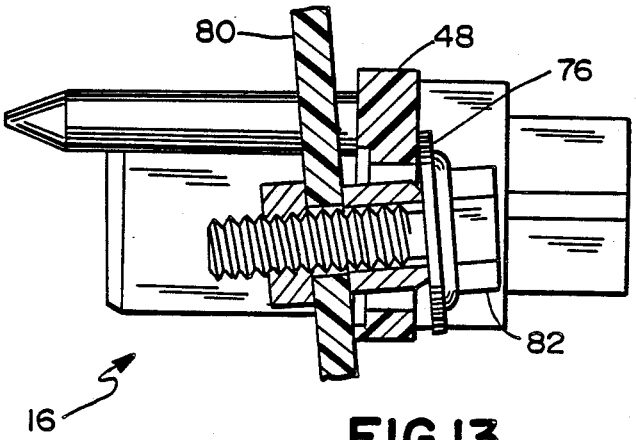
FIG. 13 is a cross section similar to FIG. 12 but showing the drawer connector rotatably moved relative to a panel.

The male panel mount connector housing 16 further comprises mounting apertures 70 and mounting collars 72 to enable the float mounting of the panel mount connector housing 16 to an appropriate panel as shown in FIG. 12 or alternatively in FIG. 13. In particular, the collar 72 is a hollow generally cylindrical collar having an aperture 74 dimensioned to receive a bolt, rivet or other connecting means. The outside diameter of the collar 72, as indicated by dimension "a" in FIG. 4 is less than the inner diameter of the mounting aperture 70, as indicated by dimension "b" in FIG. 4. Each collar 72 is maintained in an initial concentric orientation to the mounting aperture 70 by three generally radially extending frangible supports 76 which are initially unitary with the float collar 72 and the remainder of the male panel mount connector housing 16. The frangible supports 76 are initially within the mounting aperture 60 and generally aligned with a surface of the mounting flange 48; while the collar 72 initially extends from the same surface of the mounting flange 48 and is partly within the mounting aperture 70 thereof. Preferably, the collar 72 has an axial length "c" which is greater than the thickness "d" of the mounting flange 48 as shown in FIG. 3.

The mounting collar 72 functions by intially placing the male panel mount connector housing 16 relative to a panel 80 as shown in FIG. 12 such that the central aperture 74 of the collar 72 is substantially aligned with a corresponding aperture in the panel. A bolt, rivet or other suitable connecting means 82 is then passed through the aligned mounting apertures and is tightened. The tightening of the bolt 82 or other such connecting means urges the collar 72 axially into the mounting aperture 70, thereby causing the frangible supports 76 to break. As noted above, however, the outer diameter "a" of the mounting collar 72 is less than the inner diameter "b" of the mounting aperture 70. Thus, relative movement or float is achievable therebetween, as shown in phantom lines in FIG. 12, to obtain proper alignment of the male and female panel mount assemblies 56 and 22 during blind mating. This float is not limited to movement along one or two axes, as had been the case with certain prior art float mechanisms, but rather permits floating movement in all directions in the plane of the panel 80. However, the connecting means 82 used with the male panel mount drawer connector housing 16 prevents the housing 16 from moving significantly away from the corresponding panel 80. The ability to achieve float in all directions within the plane of the panel 80 substantially facilitates alignment during the blind mating of the drawer connector 12. Furthermore, and importantly, collar 62 and frangible supports 76 initially are molted unitary with housing 16 which is in sharp contrast to prior art float mechanisms employing plural components which were assembled to enable mounting to the panel. In addition to the float within the plane of the panel 80, a controlled amount of rotational float may be obtained out of the plane of the panel 80 as shown in FIG. 13. The amount of such rotational float depends upon the length "c" of the collar 72 compared to the thickness "d" of the mounting flange 48.

The drawer connector 12 is assembled by intially force fitting the drawer connector pin terminals 18 and the double ended drawer connector blade terminals 20 into the female panel mount drawer connector housing 14 to define a female panel mount assembly 22. Similarly, the drawer connector pin receiving terminals 51 and the drawer connector blade receiving terminals 52 are force fit into the male panel mount drawer connector housing 16 to define a male panel mount assembly 56. The DC terminal modules 29 with the separate DC wires or the ribbon cables electrically mounted thereto are then lockingly, but removably, engaged with the rearwardly projecting locking sockets 28 at the conductor-receiving end of the female panel mount drawer connector housing 14 to achieve electrical connection with the pin terminals 18. Similarly, the quick-disconnect AC terminals 40 with the insulating sleeves 44 thereon are engaged in the rearwardly projecting shrouds 38 of the female panel mount connector housing 14 to achieve secure but releasable electrical connection with the double ended blades 20. It will be noted that the AC leads 42 are on opposite sides of the small DC leads 36 thereby contributing to the protection of the more fragile DC termination work.

Comparable connections of the DC modules 29 and the quick-disconnect AC terminals 40 are made with the male panel mount assembly 56. The resulting female and male mount assemblies 22 and 56 defining the drawer connector 12 can be repeatedly connected and disconnected as needed. The blind mating typical with drawer connectors is facilitated by the guides 49 and 50 of the male panel mount drawer connector housing 16 and the corresponding forwardly projecting shroud 26 of the female panel mount connector housing 14. Self-aligning for the blind mating process is further facilitated by the controlled floating through at least a full 360° range of movement in the plane of the panel enabled by the frangible mounting collar 72.

After repeated connection and disconnection of the drawer connector 12, failure of at least one DC pin terminal 18, a pin receiving terminal 51 may occur. Upon such a failure the DC modules 29 and the quick-disconnect AC terminals 40 are merely disengaged from the corresponding female or male panel mount assembly 22 or 56. In particular, the original DC terminal modules 29 are easily disengaged by biasing the cantilevered walls 32 or 60 out of engagement with the locking projections 34. The female or male panel mount assembly 22 or 56 having the damaged terminal therein is discarded and is replaced by a new assembly. The DC modules 29 and the quick-disconnect AC terminals 40 are appropriately lockingly engaged with the corresponding new female or male panel mount assembly 22 or 56. This replacement procedure saves the labor intensive and costly termination work that had been performed, particularly the various conductive DC leads 36.

It will be understood by the person skilled in this art that various changes can be made to the drawer connector without departing from the scope of the invention as defined in the appended claims. For example, the drawer connector embodying the subject invention may be formed entirely for AC circuits or entirely for DC circuits. Additionally, ribbon cables may be employed in place of the separate insulated wires identified above and illustrated in the Figures. Furthermore, the particular releasable connection means for the modular components to the connector housings of the drawer connector may be altered.

We claim:

1. A modular drawer connector comprising:

opposed, mateable, panel-mountable male and female drawer connector housings, each said drawer connector housing comprising a forward mating end and an opposed conductor-receiving end, said conductor-receiving end comprising a plurality of spaced apart rearwardly projecting walls defining at least one rearwardly projecting socket, one said wall of each rearwardly projecting socket comprising a deflectable cantilevered wall having at least one locking aperture extending therethrough;

a plurality of drawer connector terminals mounted in each of the drawer connector housings, each drawer connector terminal comprising a forward mating contact portion and a rear contact portion disposed respectively at the forward mating ends and the conductor-receiving ends of said drawer connector housings, the forward mating contact portions of the drawer connector terminals being electrically mateable upon movement of the forward mating ends of the male and female drawer connector housings to a fully mated condition; and at least one DC terminal module comprising a nonconductive housing, a plurality of insulated conductors extending into said housing and a plurality of metallic terminals having rearward conductor-engaging portions electrically engaged with the respective conductors of said DC terminal module, each said metallic terminal of said DC terminal module further comprising a forward contact portion selectively mateable to a rear contact portion of one of said drawer connector terminals, said nonconductive housing of said DC terminal module being dimensioned for engagement with the rearwardly directed socket of said drawer connector housing, said nonconductive housing of said DC terminal module further comprising at least one locking protrusion releasably engageable with the locking aperture in the deflectable cantilevered wall of the rearwardly projecting socket of the drawer connector housing, whereby the DC terminal module may be disengaged from the drawer connector housing to permit replacement of the drawer connector housing and the drawer connector terminals mounted therein without retermination of the insulated conductors of said DC terminal module.

2. A modular drawer connector as in claim 1 wherein the plurality of drawer connector terminals comprises first and second pluralities of drawer connector terminals in each of said drawer connector housings, the first plurality of drawer connector terminals in each said drawer connector housing having rear contact portions engageable with the metallic terminals in the DC terminal modules, the second plurality of drawer connector terminals in each said drawer connector housing having rear contact portions defined by blade contacts, said modular drawer connector further comprising a plurality of terminated leads, each said terminated lead comprising an insulated conductor, a quick-disconnect terminal electrically contacting the conductor and an insulating sleeve surrounding said quick-disconnect terminal, said quick-disconnect terminals being engageable with the blade contacts of the second plurality of drawer connector terminals mounted in the respective drawer connector housings.

3. A modular drawer connector as in claim 1 wherein the forward mating end of the male drawer connector housing is characterized by a plurality of forwardly projecting guides, and wherein the mating end of the female drawer connector housing is defined by a forwardly projecting shroud surrounding the front mating contact portions of the terminals therein, said shroud being dimensioned to receive the guides of the male drawer connector housing for positively guiding the drawer connector housings into a mated condition.

4. A modular drawer connector as in claim 3 wherein the female drawer connector housing further comprises a plurality of dividing walls extending between and connecting spaced apart locations on said forwardly projecting shroud to surround the forward mating contact portions of at least selected drawer connector terminals, for preventing damage by the male drawer connector housing during mating.

5. A modular drawer connector as in claim 4 wherein the forward mating contact portions of the drawer connector terminals intermediate said dividing walls define pin contact portions.

6. A modular drawer connector as in claim 1 wherein the metallic terminals mounted in the DC terminal modules are insulation displacement terminals.

7. A drawer connector as in claim 1 wherein each said housing comprises a generally planar mounting flange having a mounting aperture extending therethrough for receiving mounting means for mounting said housing to a panel.

8. A drawer connector as in claim 7 wherein at least one said mounting aperture comprises a mounting collar having an external cross-sectional dimension less than the internal cross-sectional dimensions of said mounting aperture, said mounting collar being initially supported in alignment with said mounting aperture by at least one frangible support, whereby an attachment means extending through said mounting collar is operable to break the frangible supports and loosely retain said mounting collar within said mounting aperture to permit relative float therebetween.

9. A drawer connector as in claim 8 wherein said mounting aperture and said mounting collar are generally cylindrical, said mounting collar being supported generally concentrically relative to said mounting aperture.

10. A drawer connector as in claim 8 wherein said housing, said mounting collar and said frangible supports are initially of unitary construction.

11. A drawer connector as in claim 8 wherein said mounting collar has an axial length which is greater than the axial length of the mounting aperture extending through the housing.

12. A modular drawer connector comprising:

opposed, mateable, panel-mountable male and female drawer connector housings, each said drawer connector housing comprising a forward mating end and an opposed conductor-receiving end, the conductor-receiving ends of each said drawer connector housing defining at least one generally centrally disposed rearwardly projecting socket, said socket being defined by a plurality of rearwardly projecting walls, one said wall defining said socket being a deflectable cantilevered wall having locking means for lockingly retaining a terminal module therein, the conductor-receiving end of each said drawer connector housing further comprising rearwardly projecting shrouds disposed respectively on opposite sides of said rearwardly projecting socket, said shrouds being dimensioned to receive at least one quick-disconnect terminal therein;

first and second pluralities of drawer connector terminals mounted in each drawer connector housing, each drawer connector terminal comprising a forward mating contact portion disposed at the forward mating end of the associated drawer connector housing and a rear contact portion, the rear contact portions of said first plurality being disposed within the socket at the conductor-receiving end of the associated drawer connector housing, the rear contact portions of said second plurality being disposed in said rearwardly projecting shrouds, the forward mating contact portions of the drawer connector terminals being electrically mateable upon movement of the forward mating ends of the male and female drawer connector housings into a mated condition;

at least one DC terminal module comprising a nonconductive housing lockingly engageable with the locking means of the rearwardly projecting socket of the associated drawer connector housing, a plurality of insulated conductors extending into said DC terminal module and a plurality of metallic terminals engaged in said nonconductive housing, each said metallic terminal having a rearward conductor-engaging portion electrically engaging one said conductor in said nonconductive housing and a forward contact portion engageable with the rear contact portion of one of said first plurality of drawer connector terminals; and a plurality of terminated leads releasably electrically contacting the respective rear contact portions of the terminals in said second plurality of terminals, whereby the DC terminal modules and the terminated leads may be unmated from the respective drawer connector housings to permit replacement of the drawer connector housing and the terminals therein without reterminating the DC terminal modules and the terminated leads.

13. A modular drawer connector as in claim 12 wherein a plurality of the terminated leads each comprise a quick-disconnect terminal.

14. A drawer connector comprising a drawer connector housing having a mounting flange, a forward mating end and a rearward conductor-receiving end, a plurality of drawer connector terminals mounted in the drawer connector housing, said mounting flange having a plurality of mounting apertures extending therethrough for receiving mounting means to mount said housing to a panel, said mounting apertures each comprising a mounting collar having an external cross-sectional dimension less than the internal cross-sectional dimension of the corresponding mounting aperture, said mounting collar being initially supported in alignment with said mounting aperture by at least one frangible support, said frangible support being breakable from said mounting flange upon engagement of said mounting means with the drawer connector, the dimensions of said mounting collar relative to said mounting aperture permitting a controlled amount of float of said drawer connector relative to said panel.

15. A drawer connector as in claim 14 wherein the mounting collar has an axial length which exceeds the thickness of the mounting flange.

16. A drawer connector as in claim 14 wherein said drawer connector housing is of unitary molded plastic construction.

17. A drawer connector as in claim 14 wherein each said mounting aperture is generally cylindrical and wherein said mounting collar is generally cylindrical, said mounting collar being supported generally concentrically relative to said mounting aperture by said plurality of frangible supports.

18. A drawer connector as in claim 14 wherein each said drawer connector terminal includes a forward mating contact portion and a rear conductor engaging portion disposed respectively at the forward mating end and the conductor-receiving end of said drawer connector, said drawer connector further comprising at least one terminated lead including at least one insulated conductor, a metallic terminal having a rearward conductor-engaging portion electrically engaging the conductor and having a forward contact portion, said forward contact portion of the terminated lead being selectively removably mated to a rear contact portion of one of said drawer connector terminals.

19. A modular drawer connector comprising:

opposed, mateable, panel-mountable male and female drawer connector housings, each drawer connector housing including a forward mating end and an opposed conductor-receiving end, said conductor-receiving end having a plurality of spaced apart rearwardly projecting walls defining at least one rearwardly projecting socket;

a plurality of drawer connector terminals mounted in each of said drawer connector housings, each drawer connector terminal including a forward mating contact portion and a rear contact portion disposed respectively at the forward mating ends and the conductor receiving ends of said drawer connector housings, the forward mating contact portions of the drawer connector housings being electrically mateable upon movement of the forward mating ends of the male and female drawer connector housings to a fully-mated condition;

at least one DC terminal module including a nonconductive housing, a plurality of insulated conductors extending into said housing and a plurality of metallic terminals having rearward conductor engaging portions electrically engaged with the respective conductors of said DC terminal modules, each said metallic terminal of said DC terminal module further including a forward contact portion selectively mateable with a rear contact portion of one of said drawer connector terminals, and said nonconductive housing of the DC connector module being dimensioned for engagement with the rearwardly projecting socket of said drawer connector housing; and interengaging means cooperating between said DC terminal module housing and said rearwardly projecting socket for releasably locking the DC terminal module in mated relation to the conductor-receiving end of the drawer connector;

whereby, the DC terminal module may be disengaged from the drawer connector housing to permit repair or replacement of the drawer connector housing and the drawer connector terminals mounted therein without retermination of the insulated conductors of said DC terminal module.

20. A modular drawer connector as in claim 19 wherein said interengaging means further includes polarizing means for limiting permissible orientations of said DC terminal module during engagement of the DC terminal module with the rearwardly projecting socket.

* * * * *

UNITED STATES PATENT AND TRADEMARK OFFICE

CERTIFICATE OF CORRECTION

PATENT NO. : 4,915,641

DATED : 04/10/90

INVENTOR(S) : Michael J. Miskin, Wayne A. Zahlit, Michael J. Gardner and Philip J. Dambach It is certified that error appears in the above-identified patent and that said Letters Patent is hereby corrected as shown below:

On the title page,
add the following two people as co-inventors:

Michael J. Gardner

Philip J. Dambach

Signed and Sealed this

Nineteenth Day of March, 1991

*Attest:*

*Attesting Officer*

HARRY F. MANBECK, JR.

*Commissioner of Patents and Trademarks*